US006957885B2

(12) United States Patent
Noguchi et al.

(10) Patent No.: US 6,957,885 B2
(45) Date of Patent: Oct. 25, 2005

(54) IMAGE OUTPUT APPARATUS AND CONTROL METHOD THEREFOR

(75) Inventors: Hiroyuki Noguchi, Kanagawa-ken (JP); Yasushi Ishida, Tokyo (JP); Shigeyuki Sugiyama, Kanagawa-ken (JP); Katsumi Obana, Chiba-ken (JP); Takayuki Nishinohara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/033,146

(22) Filed: Jan. 12, 2005

(65) Prior Publication Data

US 2005/0157134 A1 Jul. 21, 2005

(30) Foreign Application Priority Data

Jan. 16, 2004 (JP) ..... 2004-009551

(51) Int. Cl.[7] ..... B41J 2/01; B41J 29/38; G03G 15/00

(52) U.S. Cl. ..... 347/101; 347/5; 399/82

(58) Field of Search ..... 347/101, 104, 347/5, 16; 399/82; 396/310; 400/61, 62, 400/63, 76

(56) References Cited

U.S. PATENT DOCUMENTS

| | | | | |
|---|---|---|---|---|
| 6,239,817 | B1 * | 5/2001 | Meyer | 347/36 |
| 6,411,324 | B1 * | 6/2002 | Christiansen et al. | 347/248 |
| 6,415,115 | B1 * | 7/2002 | Moritani | 399/82 |
| 6,612,240 | B1 * | 9/2003 | Silverbrook et al. | 101/424.1 |

FOREIGN PATENT DOCUMENTS

| | | | | |
|---|---|---|---|---|
| JP | 4-186335 | 7/1992 | | |
| JP | 7-141488 | 6/1995 | | |
| JP | 08-331494 | 12/1996 | | |
| JP | 10-213856 | 8/1998 | | |
| JP | 10-224528 | 8/1998 | | |
| JP | 10-233920 | 9/1998 | | |
| JP | 2000-357070 | 12/2000 | | |
| JP | 2000-358132 | 12/2000 | | |
| JP | 2001-313784 | 11/2001 | | |
| JP | 2002-165085 | 6/2002 | | |
| JP | 2003-005304 | 1/2003 | | |
| JP | 2003-075944 | 3/2003 | | |
| JP | 2003202633 A | * 7/2003 | | G03B 27/32 |
| JP | 2003303065 A | * 10/2003 | | G06F 3/12 |

OTHER PUBLICATIONS

U.S. Appl. No. 11/036,124, filed Jan. 18, 2005.
U.S. Appl. No. 11/032,173, filed Jan. 11, 2005.
U.S. Appl. No. 11/032,037, filed Jan. 11, 2005.
U.S. Appl. No. 11/062,844, filed Feb. 23, 2005.

* cited by examiner

*Primary Examiner*—Manish Shah
*Assistant Examiner*—Leonard Liang
(74) *Attorney, Agent, or Firm*—Fitzpatrick, Cella, Harper & Scinto

(57) ABSTRACT

In an image output apparatus which can perform entire-surface printing and both-sided printing, if an instruction to print additional information together with an image is issued or printing of the additional information together with the image is set, it is determined whether to perform entire-surface printing or normal printing. In the case of entire-surface printing, the additional information is printed on the back surface while in the case of normal printing, the additional information is printed outside an image printing area. This makes it possible to print the additional information of an image to be printed and output at a position which does not overlap the image.

13 Claims, 6 Drawing Sheets

IMAGE OUTPUT APPARATUS AND CONTROL METHOD THEREFOR

FIELD OF THE INVENTION

The present invention relates to an image output apparatus which prints image information on a printing medium and a control method for the image output apparatus.

BACKGROUND OF THE INVENTION

Recent image output apparatuses typified by an ink-jet color printer are becoming high in image quality. An increasing number of image output apparatuses can make a print equivalent to a photo obtained by photographing an image using a silver halide film and printing the image on a photographic paper sheet, using, particularly, a paper sheet dedicated to photo output.

Some of these image output apparatuses can print data on the entire surface of each paper sheet (so-called borderless printing), and output quality closes to that of a photo obtained using a silver halide film. The improved functions, low cost, and convenience of a digital camera or the like are promoting a shift to digital photos.

However, in outputting a digital image using an image output apparatus, it is difficult to manage the output result without additional information including the file name, image size, photographing date and time, and the like of the digital image data. In the case of outputting an image on a photographic paper as a general silver halide photo, the corresponding frame number of the silver halide film (and, in some cases, processing parameters in printing) is printed on the back surface of the photographic paper, and thus, output results can be managed using such information.

For this reason, there is proposed a method of printing image quality adjustment parameters together with each digital image in printing and outputting the image (see, e.g., Japanese Patent Laid-Open No. 10-233920). In this method, parameters are printed on a paper sheet separate from an image, on the image, or on the back surface of the image.

In the method described in Japanese Patent Laid-Open No. 10-233920, the presence/absence of parameter printing and printing location are determined on the basis of the user's designation. The method does not specifically consider printing parameters in an area other than an image. For this reason, in printing parameters on the surface (same surface) of the same paper as an image in the case of Japanese Patent Laid-Open No. 10-233920, as shown in FIG. 10, the parameters may be printed over the image.

SUMMARY OF THE INVENTION

The present invention has as its main object to solve the conventional problem.

According to the present invention, the foregoing object is attained by providing an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, comprising a controller which controls the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

According to another aspect of the present invention, the foregoing object is attained by providing a control method for an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, comprising controlling the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

In still another aspect of the present invention, the foregoing object is attained by providing a program for causing a computer to execute a control method for an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, comprising a control module which controls the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

In still another aspect of the present invention, the foregoing object is attained by providing a computer-readable recording medium which stores a program for causing a computer to execute a control method for an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, wherein the program comprises a control module which controls the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

Other objects and advantages besides those discussed above shall be apparent to those skilled in the art from the description of a preferred embodiment of the invention which follows. In the description, reference is made to accompanying drawings, which forms a part therefor, and which illustrate an example of the various embodiments of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

First Embodiment

Preferred embodiments of the present invention will now be described in detail in accordance with the accompanying drawings.

Note that the dimensions, materials, shapes, relative positions, and the like of the components described in the embodiment below are merely examples. The scope of the present invention is not limited to these, unless otherwise specified.

Figure 2:
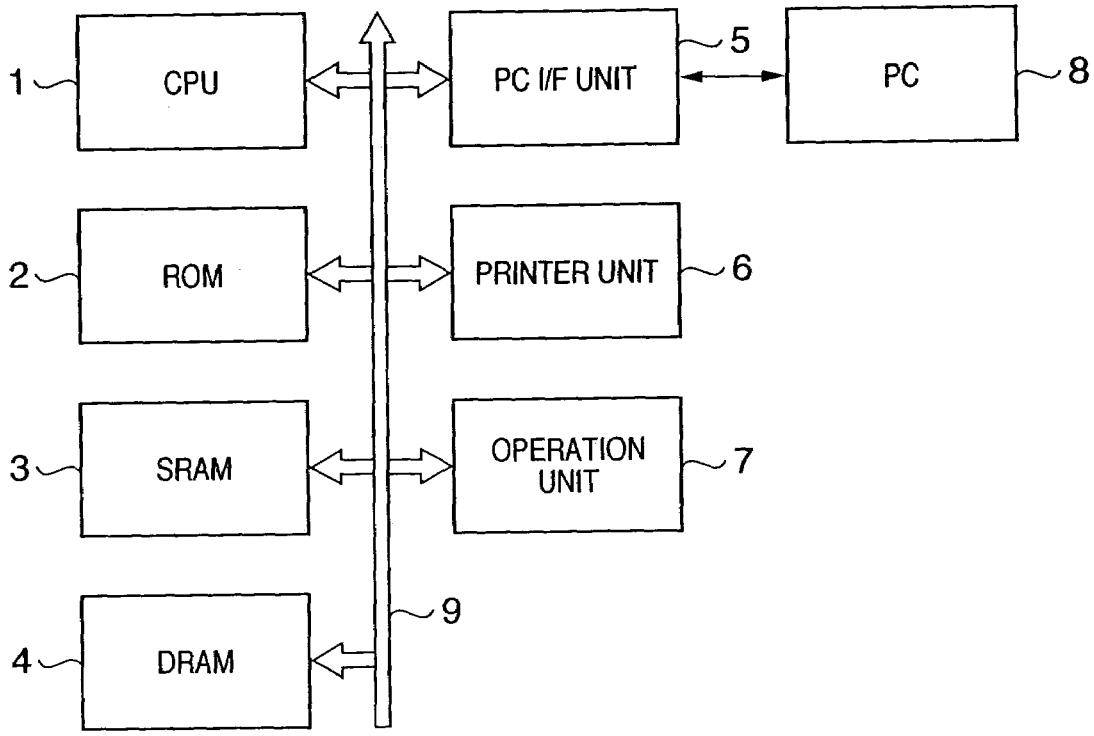
FIG. 2 is a block diagram showing an example of the arrangement of the image output apparatus according to the first embodiment of the present invention.

FIG. 2 is a block diagram showing the basic arrangement of an image output apparatus according to an embodiment of the present invention.

In FIG. 2, reference numeral 1 denotes a CPU (Central Processing Unit) which controls the units of the apparatus. Reference numeral 2 denotes a ROM which stores a control processing program executed by the CPU 1 and parameters required for the control process. Reference numeral 3 denotes an SRAM (static RAM) which is used to store various unique data and is used as a work area for processing of the CPU 1. Reference numeral 4 denotes a DRAM which stores image data or the like received from an external PC (Personal Computer) 8 and can also be used as a work area for the CPU 1. Reference numeral 5 denotes a PC I/F unit for interfacing with the external PC 8. Reference numeral 6 denotes a printer unit for printing image data or the like received from the external PC 8. In this embodiment, the printer unit 6 can perform entire-surface (borderless) printing and double-sided printing. Reference numeral 7 denotes an operation unit which includes keys and buttons for the user to issue instructions to the apparatus or perform various operations, a display device and speaker for notifying the user of the operating state of the apparatus, and the like.

The CPU 1, ROM 2, SRAM 3, DRAM 4, PC I/F 5, printer unit 6, and operation unit 7 are connected to a system bus 9. These units exchange data with each other using the system bus 9.

The operation of printing digital image data by the image output apparatus with the above-mentioned arrangement will be described.

In printing digital image data, a digital image print request is first issued from the external PC 8. The request is sent to the CPU 1 through the PC I/F 5. In accordance with the control program stored in the ROM 2, the CPU 1 initializes the blocks to prepare for digital image printing.

When digital image data is sent from the external PC 8, the data passes through the PC I/F 5. The CPU 1 causes the DRAM 4 to store the digital image data while controlling the system bus 9. At this time, additional information (data such as the file name, photographing date and time, and the like) associated with the digital image data, which is sent together with (or included in) the digital image data, is also stored in the DRAM 4. The additional information may be stored in the SRAM 3 for the purpose of management.

Printing-related parameters including the printing date and time, number of print, pages to be printed, paper size, the presence/absence of the additional information, and the like and the information related to the digital image data (additional information) including the file name, image size, photographing date and time, and the like need to be stored for the received digital image data. To this end, these parameters and additional information sent from the external PC 8 (or set by the operation unit 7) are also stored in the DRAM 4 or SRAM 3.

Digital image data to be printed, printing-related parameters, and additional information may be sent or set in any data format by any procedure as far as the image output apparatus can recognize these data.

When the printer unit 6 is ready to print digital image data (e.g., the printer unit 6 has completed a previous print job and is ready to print new image data), the CPU 1 sends digital image data stored in the DRAM 4 to the printer unit 6 and starts printing the digital image. At this time, if whether to print additional information stored in the DRAM 4 or SRAM 3 is set by the external PC 8 or operation unit 7, the additional information is printed at the time of printing the digital image data.

A case has been described wherein digital image data sent from the external PC 8 is printed. In printing digital image data stored in the DRAM 4, a print instruction can be issued using the operation unit 7. More specifically, the CPU 1 displays a known hierarchical setup menu on, e.g., the display unit included in the operation unit 7. If a menu item for printing image files stored in the DRAM 4 is selected, a list of the stored images is presented, and selected image data is printed. More specifically, the CPU 1*a* receives a print request from the operation unit 7 and sends the digital image data stored in the DRAM 4 to the printer unit 6, thereby starting printing. Whether to print additional information associated with the digital image data at the time of printing can be determined on the basis of the setting by the operation unit 7.

Figure 1:
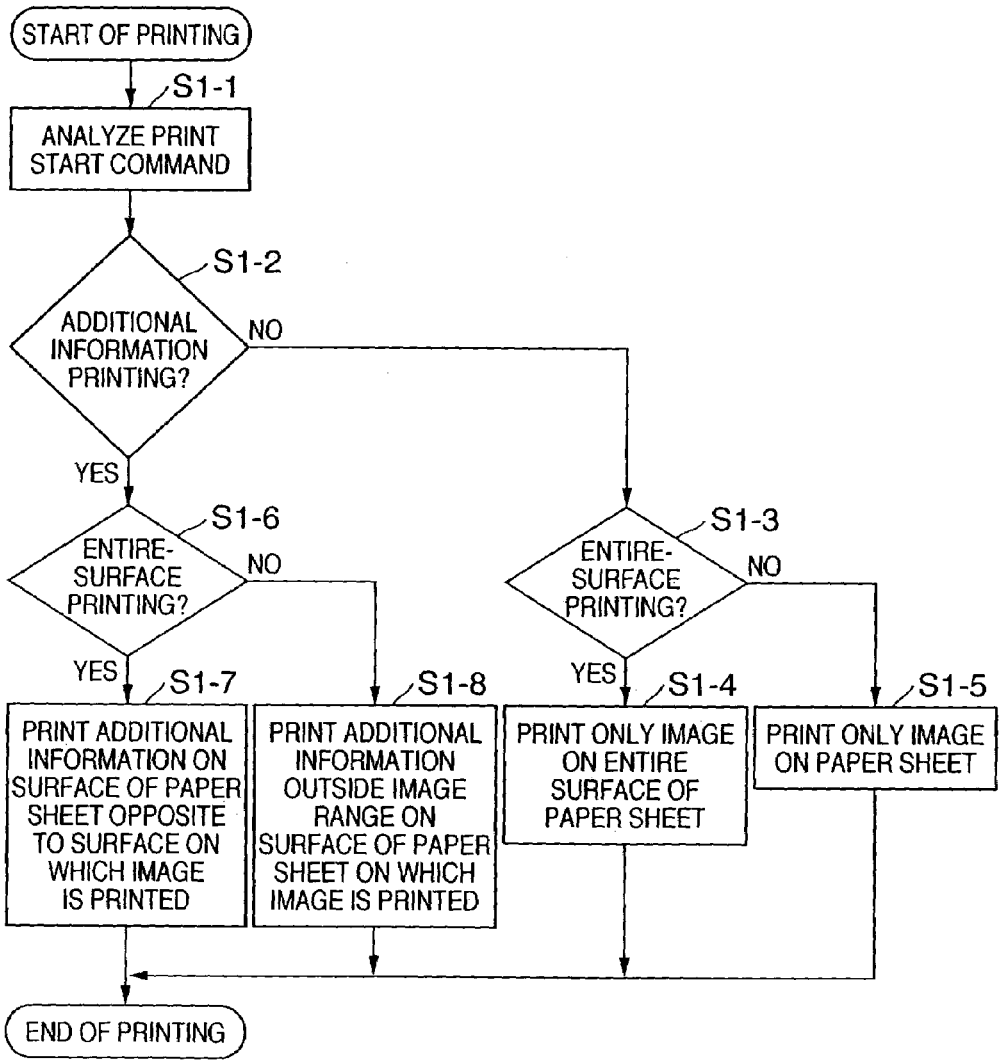
FIG. 1 is a flowchart showing the operation of an image output apparatus according to the first embodiment of the present invention.

FIG. 1 is a flowchart showing the above-mentioned operation of printing digital image data. The operation of the image output apparatus according to this embodiment will be described with reference to the flowchart.

In step S1-1, a print start command for printing is first received. As described above, the CPU 1 receives the print start command from the external PC 8 or receives the print start instruction through the operation unit 7. The CPU 1 analyzes the print start command, initializes the blocks, and prepares for digital image data printing.

In step S1-2, it is determined whether or not printing of additional information of digital image data to be printed is set or an instruction to print the additional information is issued. The CPU 1 performs this determination by receiving a command from the external PC 8 or a setting made by the operation unit 7 (stored in, e.g., the SRAM 3) and analyzing it, in the same manner as in reception of a print start command. If it is determined that an instruction to print the additional information is not issued or printing of the additional information is not set (NO in step S1-2), the flow advances to step S1-3.

In step S1-3, it is determined whether to print the digital image data on the entire surface of a paper sheet. The CPU 1 also performs this determination by receiving a command from the external PC 8 or the setting made by the operation unit 7 (stored in, e.g., the SRAM 3) and analyzing it.

If it is determined that an instruction for entire-surface printing is issued or entire-surface printing is set (YES in step S1-3), the CPU 1 sends the digital image data to be printed to the printing unit 6 and instructs the printing unit 6 to perform entire-surface printing (borderless printing). Upon reception of the information, the printer unit 6 prints the received digital image data on the entire surface of a paper sheet (step S1-4).

On the other hand, if it is determined that an instruction for entire-surface printing is not issued or entire-surface printing is not set (NO in step S1-3), the CPU 1 sends the digital image data to be printed to the printing unit 6 and instructs the printing unit 6 to perform normal printing (border printing) to the printing unit 6. Upon reception of the information, the printer unit 6 prints the received digital image data in a normal mode (step S1-5).

If it is determined that an instruction to print the additional information is issued or printing of the additional information is set (YES in step S1-2), the flow advances to step S1-6.

In step S1-6, it is determined whether to print the digital image data on the entire surface of a paper sheet, similarly to step S1-3.

If it is determined that an instruction for entire-surface printing is issued or entire-surface printing is set (YES in step S1-6), the CPU 1 sends the digital image data to be printed and its additional information to the printing unit 6 and instructs the printing unit 6 to perform entire-surface printing (borderless printing). Upon reception of the information, the printer unit 6 prints the received digital image data on the entire surface of a paper sheet and prints the additional information of the image data on the back surface of the paper sheet (step S1-7). To print data on the back surface of a paper sheet, e.g., an automatic double-sided print function of the printer unit 6 is used. This printing can be implemented by turning over the paper sheet after image data printing and printing data on the back surface.

On the other hand, if it is determined that an instruction for entire-surface printing is not issued or entire-surface printing is not set (NO in step S1-6), the CPU 1 sends the digital image data to be printed and its additional information to the printing unit 6 and instructs the printing unit 6 to perform normal printing (border printing). Upon reception of the information, the printer unit 6 prints the received digital image data in an image printing area except the margins (edges or a portion outside the area) of the paper sheet and prints the additional information of the image data in a portion (the edges or the portion outside the area) except the image printing area (step S1-8). At this time, since the additional information is printed outside the area for normal printing, an entire-surface printing function of the printer unit 6 is practically used.

Figure 3A:
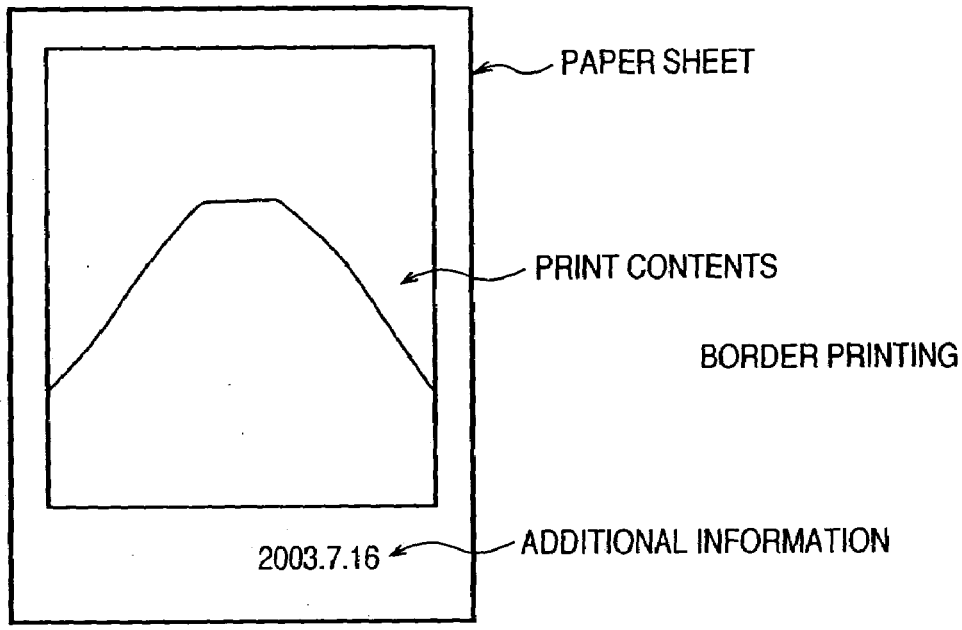
FIGS. 3A and 3B are views showing examples of printing results from the image output apparatus according to the first embodiment of the present invention.
Figure 3B:
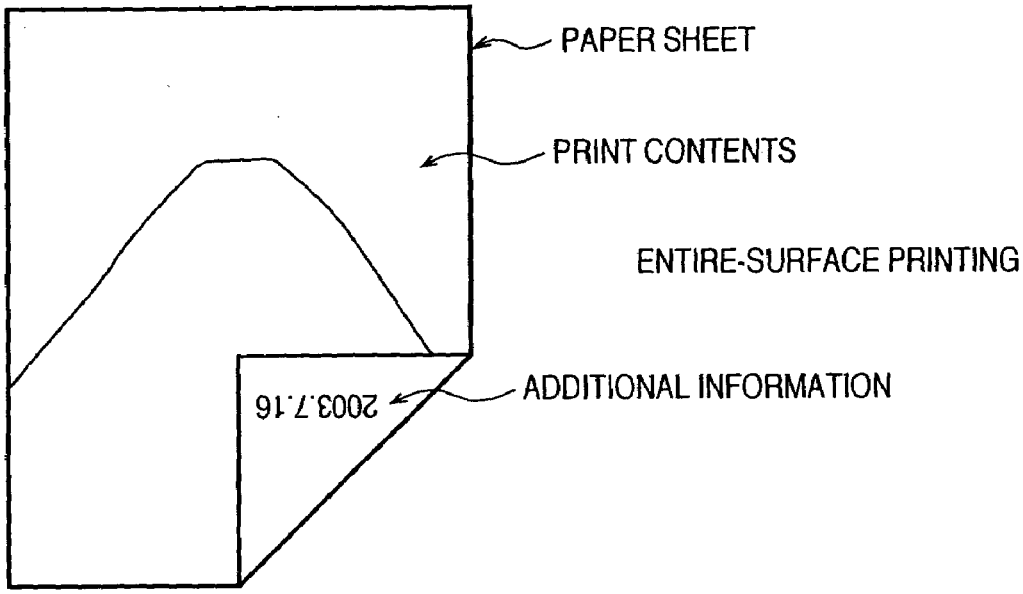

FIGS. 3A and 3B show results of printing in steps S1-7 and S1-8. FIG. 3B corresponds to the result of the printing process in step S1-7. If digital image data is printed on the entire surface of a printing paper sheet, additional information is printed on the back surface of the paper sheet. FIG. 3A corresponds to the result of the printing process in step S1-8. Additional information is printed in an area (outside a printing area) where digital image data is not printed in normal printing.

As described above, according to this embodiment, in printing image data together with its additional information by an image output apparatus which can perform entire-surface printing, the additional information can be printed outside an area for normal printing in the case of normal printing or can be printed on the back surface in the case of entire-surface printing. This makes it possible to prevent additional information from being printed over a corresponding image. The printing location of additional information is automatically determined in accordance with whether to perform entire-surface printing or normal printing. At the time of printing, the presence/absence of printing of additional information only needs to be designated, and the position need not be designated.

Second Embodiment

A general image output apparatus has been described. The present invention can also be applied to an image output apparatus such as a digital multifunction apparatus which has an image reading apparatus.

A specific example is an image output apparatus which can switch the printing location of additional information including the date of an original and the like between the back surface of a printing sheet and a portion outside the printing area on the printing surface in copying operation by setting whether to print data on the entire surface of the paper sheet.

Figure 4:
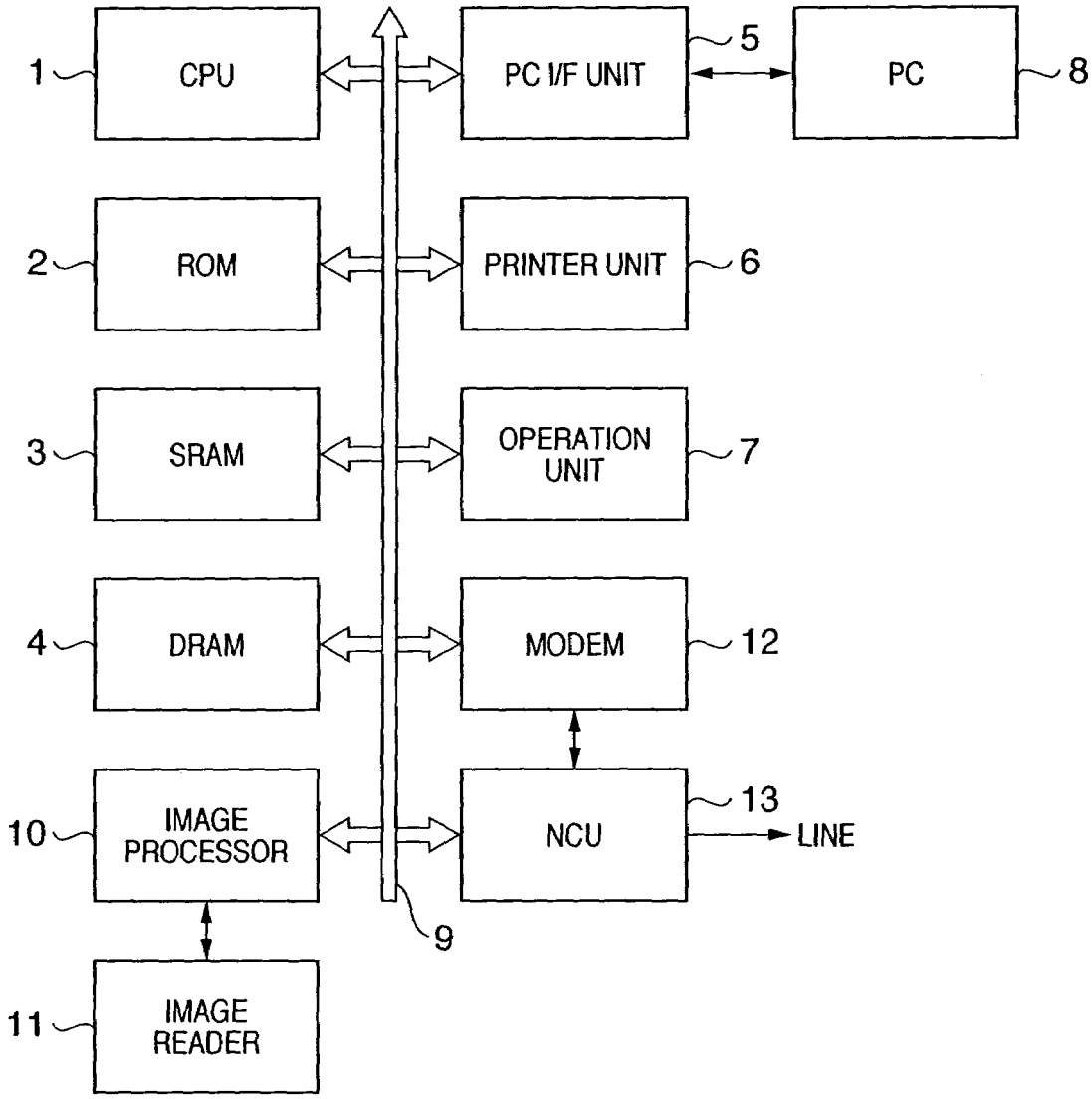
FIG. 4 is a block diagram showing an example of the arrangement of an image output apparatus according to the second embodiment of the present invention.

FIG. 4 is a block diagram showing the basic arrangement of a digital multifunction apparatus as an example of an image output apparatus according to this embodiment.

FIG. 4 is different from FIG. 2 showing the image output apparatus according to the first embodiment in that an image processor 10, image reader 11, MODEM 12, and NCU 13 are further provided. The image processor 10 connects to the image reader 11. The image processor 10 has a function of performing various image processes including a shading correction process of correcting shading distortion contained in an original image read by the image reader 11. The image reader 11 is, e.g., a flatbed scanner having an automatic document feeder. The image reader 11 converts light reflected by a white reference member and an original irradiated by an internal light source into electrical signals to output them to the image processor 10. The MODEM 12 is a so-called facsimile modem and has a function of transmitting/receiving facsimile data to/from a facsimile apparatus on the other end connected through the NCU 13 and a telephone line. The NCU (Network Control Unit) 13 has a function of connecting the image output apparatus according to this embodiment to a public telephone network.

The image processor 10, MODEM 12, and NCU 13 are connected to a system bus 9. The units exchange data with each other using the system bus 9. Note that the MODEM 12 directly exchanges data with the NCU 13.

The copying operation of the image output apparatus with this arrangement will be described.

In the case of copying operation, a copying operation request is sent from an operation unit 7 to a CPU 1. The CPU 1 initializes the units in accordance with a control program stored in a ROM 2.

The CPU 1 then performs image reading processing for an original set on an original table or automatic document feeder of the image reader 11 while controlling the image processor 10 and image reader 11. At the same time, the CPU 1 causes a DRAM 4 to store digital image data read by the image reader 11 and subjected to a predetermined image process in the image processor 10 while controlling the system bus 9. In this process, additional information contained in the read original image is detected and is stored in the DRAM 4. At this time, the additional information may be stored in the SRAM 3 for the purpose of management. An example of the additional information contained in the original image is date data (or photographing date and time, message, or the like) printed on a photographic original. The date data can be detected by a known character recognition method such as OCR. To read a photographic film in which the additional information of each recorded image is magnetically recorded, the image reader 11 may have a function of detecting additional information magnetically recorded on a photographic film, and detected additional information may be stored in the DRAM 4.

When a printer unit 6 is ready to print digital image data, the CPU 1 sends digital image data stored in the DRAM 4 to the printer unit 6 and starts printing the digital image data. At this time, if whether to print additional information stored in the DRAM 4 or SRAM 3 is determined in accordance with a setup value which can be changed by the operation unit 7, the additional information can be printed at the time of printing the digital image data.

The copying operation will be described further with reference to the flowchart in FIG. 6. The flowchart in FIG. 6 is different from that in FIG. 1 in original image data reading process in steps S2-3 and S2-7 and within-original-image additional information detection process in step S2-7.

Figure 6:
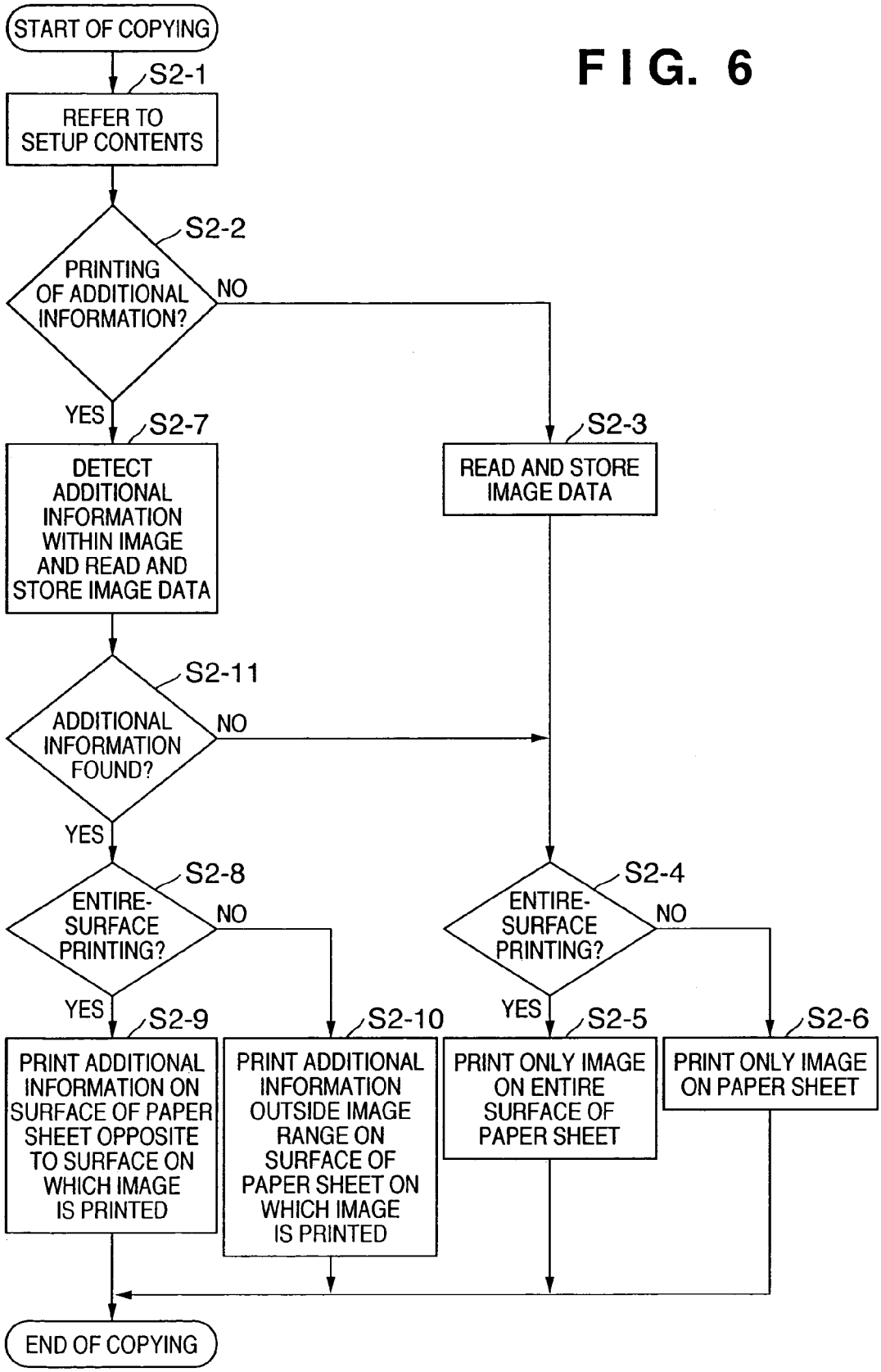
FIG. 6 is a flowchart showing the operation of the image output apparatus according to the second embodiment of the present invention.

The flowchart in FIG. 6 starts when the CPU 1 detects that an instruction to start copying is issued by, e.g., pressing a copy start key of the operation unit 7.

In step S2-1, the CPU 1 initializes the blocks. The CPU 1 refers to the setup contents stored in, e.g., the SRAM 3 and prepares for printing of additional information and printing of digital image data.

In step S2-2, it is determined whether the referred setup contents indicate printing of the additional information of digital image data. If printing of additional information is not set (NO in step S2-2), the flow advances to step S2-3.

In step S2-3, the CPU 1 performs image reading operation for an original while controlling the image processor 10 and image reader 11. The CPU 1 causes the DRAM 4 to store the resultant digital image data.

In step S2-4, it is determined whether the setup contents referred to in step S2-1 indicate printing on the entire surface of a paper sheet (borderless printing)=.

If it is determined that an instruction for entire-surface printing is issued or entire-surface printing is set (YES in step S2-4), the CPU 1 sends the digital image data to be printed to the printing unit 6 and instructs the printing unit 6 to perform entire-surface printing (borderless printing). Upon reception of the information, the printer unit 6 prints the received digital image data on the entire surface of a paper sheet (step S2-5).

On the other hand, if it is determined that an instruction for entire-surface printing is not issued or entire-surface printing is not set (NO in step S2-4), the CPU 1 sends the digital image data to be printed to the printing unit 6 and instructs the printing unit 6 to perform normal printing (border printing). Upon reception of the information, the printer unit 6 prints the received digital image data in a normal mode (step S2-6).

If it is determined that printing of the additional information is set (YES in step S2-2), the flow advances to step S2-7.

Figure 5:
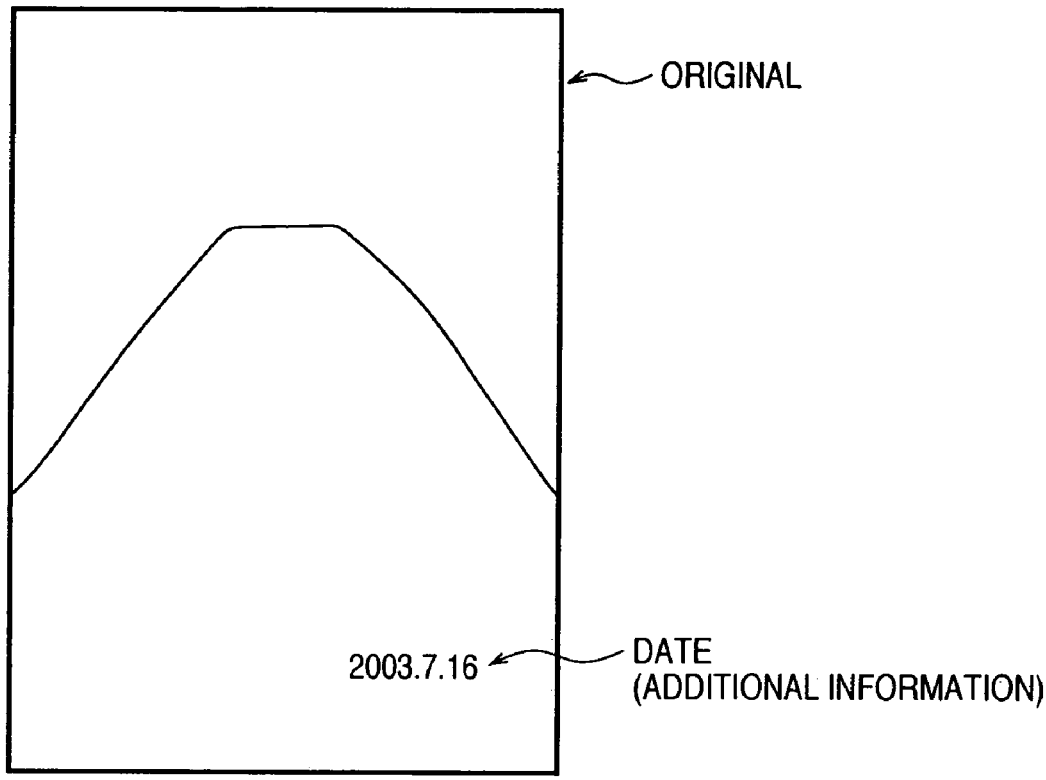
FIG. 5 is a view showing an example of a reflection original which can be used in the image output apparatus according to the second embodiment of the present invention.

In step S2-7, the CPU 1 performs image reading processing for an original while controlling the image processor 10 and image reader 11. The CPU 1 causes the DRAM 4 to store the resultant digital image data and at the same time, detects the additional information within the original. For example, if the original contains a date, as shown in FIG. 5, the CPU 1 extracts the portion as the additional information by a known detection method such as OCR and causes the DRAM 4 or SRAM 3 to store the extraction result.

In step S2-11, it is determined whether any additional information is detected in step S2-7. If no additional information is detected, the flow shifts to step S2-4. In step S2-4, subsequent processing is performed in the same manner as in a case wherein printing of additional information is not set.

If any additional information is detected, the flow advances to step S2-8 to determine whether entire-surface printing is set.

If it is determined that an instruction for entire-surface printing is issued or entire-surface printing is set (YES in step S2-8), the CPU 1 sends the digital image data to be printed and its additional information detected in step S2-7 to the printer unit 6 and instructs the printer unit 6 to perform entire-surface printing (borderless printing). Upon reception of the information, the printer unit 6 prints the received digital image data on the entire surface of a paper sheet and prints the additional information of the image data on the back surface of the paper sheet (step S2-9). To print data on the back surface of a paper sheet, e.g., an automatic double-sided print function of the printer unit 6 is used. This printing can be implemented by turning over the paper sheet after image data printing and printing data on the back surface.

On the other hand, if it is determined that an instruction for entire-surface printing is not issued or entire-surface printing is not set (NO in step S2-8), the CPU 1 sends the digital image data to be printed and its additional information detected in step S2-7 to the printing unit 6 and instructs the printing unit 6 to perform normal printing (border printing). Upon reception of the information, the printer unit 6 prints the received digital image data in an image printing area except the margins (edges or a portion outside the area) of the paper sheet and prints the additional information of the image data in a portion (the edges or the portion outside the area) except the image printing area (step S2-10). At this time, since the additional information is printed outside the area for normal printing, an entire-surface printing function of the printer unit 6 is practically used.

FIGS. 3A and 3B show results of printing in steps S2-10 and S2-9 obtained when the copying operation is performed for the original in FIG. 5. FIG. 3B corresponds to the result of the printing process in step S2-9. If digital image data is printed on the entire surface of a printing paper sheet, additional information is printed on the back surface of the paper sheet. FIG. 3A corresponds to the result of the printing process in step S2-10. Additional information is printed in an area (outside a printing area) where digital image data is not printed in normal printing.

As described above, according to this embodiment, in printing image data together with its additional information by an image output apparatus which has an original reading apparatus, the additional information can be printed outside an area for normal printing in the case of normal printing or can be printed on the back surface in the case of entire-surface printing, similarly to the first embodiment. This makes it possible to prevent additional information from being printed over a corresponding image. The printing location of additional information is automatically determined in accordance with whether to perform entire-surface printing or normal printing. At the time of printing, the presence/absence of printing of additional information only needs to be designated, and the position need not be designated.

Other Embodiment

The above-mentioned embodiments have described a case wherein only additional information related to digital image data is used as print data other than an image. Parameters such as a number of print and the number of pages and additional information including printing date and time can be printed together.

In the first embodiment, the additional information can be obtained by receiving from a PC 8 or referring to the contents set as the additional information by an operation unit 7. In the second embodiment, the additional information can be obtained by referring to the contents set after or before original reading by the operation unit 7. In either case, the additional information is stored in a DRAM 4 or SRAM 3 and can be printed together with the additional information.

In this case, it is determined in step S2-11 of the second embodiment whether there is any additional information or additional information.

The second embodiment has described only a case wherein a reflection original as shown in FIG. 5 is copied as an original. The same processing can be performed for a transparent original such as a film or the like by using an image reader 11 which can read a transparent original. More specifically, in step S2-7, additional information (date information, frame number, and the like) contained in a transparent original such as a film or the like is detected and is printed while being associated with the read digital image data. This makes it possible to print additional information even in copying operation for a transparent original such as a film or the like.

In copying operation for a transparent original such as a film or the like as well, additional information including the number of print, the number of pages, printing date and time, and the like can be printed together with additional information in the same manner as in copying operation for a reflection original.

In the above-mentioned embodiments, not additional information but only additional information can be printed together with digital image data.

Note that the present invention includes a case wherein the equivalent functions are achieved by supplying a software program that implements the functions of the aforementioned embodiments directly from a recording medium or using wired/wireless communications to a system or apparatus having a computer that can execute the program, and executing the supplied program by the computer of that system or apparatus.

Therefore, the program code itself supplied to and installed in the computer to implement the functional process of the present invention using the computer implements the present invention. That is, the present invention includes the computer program itself for implementing the functional process of the present invention.

In this case, the form of program is not particularly limited, and an object code, a program to be executed by an interpreter, script data to be supplied to an OS, and the like may be used as long as they have the program function.

As the recording medium for supplying the program, for example, magnetic recording media such as a flexible disk, hard disk, magnetic tape, and the like, optical/magnetooptical storage media such as an MO, CD-ROM, CD-R, CD-RW, DVD-ROM, DVD-R, DVD-RW, and the like, a nonvolatile semiconductor memory, and so forth may be used.

As a program supply method using the wired/wireless communications, a server on a computer network may store a data file (program data file) that can be a computer program which forms the present invention on a client computer, such as the computer program itself which forms the present invention, a compressed file including an automatic installation function, or the like, and the program data file may be downloaded to the client computer which establishes connection to the server. In this case, the program data file may be segmented into a plurality of segment files, which may be allocated on different servers.

That is, the present invention includes a server apparatus which makes a plurality of users download the program data file for implementing the functional process of the present invention on a computer.

Also, a storage medium such as a CD-ROM or the like, which stores the encrypted program of the present invention, may be delivered to the user, the user who has cleared a predetermined condition may be allowed to download key information that is used to decrypt the program from a home page via the Internet, and the encrypted program may be executed using that key information to be installed on a computer, thus implementing the present invention.

The functions of the aforementioned embodiments may be implemented not only by executing the readout program code by the computer but also by some or all of actual processing operations executed by an OS or the like running on the computer on the basis of an instruction of that program.

Furthermore, the functions of the aforementioned embodiments may be implemented by some or all of actual processes executed by a CPU or the like arranged in a function extension board or a function extension unit, which is inserted in or connected to the computer, after the program read out from the recording medium is written in a memory of the extension board or unit.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-009551 filed on Jan. 16, 2004, which is hereby incorporated by reference herein.

What is claimed is:

1. An image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, comprising a controller which controls said printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

2. The apparatus according to claim 1, further comprising an acquisition unit which acquires the image data to be printed and the information to be printed together with the image data.

3. The apparatus according to claim 1, wherein said acquisition unit acquires the image data to be printed and the information to be printed together with the image data from an external device.

4. The apparatus according to claim 1, wherein said acquisition unit comprises an image reader which reads an original image and generates the image data, and said acquisition unit acquires the information to be printed together with the image data from image data generated by the image reader.

5. The apparatus according to claim 1, wherein the information to be printed together with the image data is one of a printing parameter for the image data and preset information.

6. The apparatus according to claim 1, wherein the information to be printed together with the image data is information related to the image data.

7. A control method for an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, comprising controlling the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

8. The method according to claim 7, wherein the image data and the information to be printed together with the image data are acquired from an external device.

9. The method according to claim 7, further comprising:

reading an original image to generate the image data, and acquiring from generated image data the information to be printed together with the image data.

10. The method according to claim 7, wherein the information to be printed together with the image data is one of a printing parameter for the image data and preset information.

11. The method according to claim 7, wherein the information to be printed together with the image data is information related to the image data.

12. A program for causing a computer to execute a control method for an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, comprising a control module which controls the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

13. A computer-readable recording medium which stores a program for causing a computer to execute a control method for an image output apparatus which can perform entire-surface printing of printing an image on an entire surface of a printing medium and normal printing of printing an image while leaving a margin, has a printing unit which prints on two sides of the printing medium, and prints an image on the printing medium on the basis of a print request, wherein the program comprises a control module which controls the printing unit to print image data on one side of the printing medium and print information to be printed together with the image data on the other side of the printing medium if the print request requests the entire-surface printing and to print the image data on one side of the printing medium and print the information to be printed together with the image data in a margin of the one side of the printing medium if the print request requests the normal printing.

* * * * *

UNITED STATES PATENT AND TRADEMARK OFFICE

CERTIFICATE OF CORRECTION

PATENT NO. : 6,957,885 B2
APPLICATION NO. : 11/033146
DATED : October 25, 2005
INVENTOR(S) : Noguchi et al.

It is certified that error appears in the above-identified patent and that said Letters Patent is hereby corrected as shown below:

COVER PAGE:

(75) Inventors: "Hiroyuki Noguchi, Kanagawa-ken (JP; Yasushi Ishida, Tokyo (JP); Shigeyuki Sugiyama, Kanagawa-ken (JP; Katsumi Obana, Chiba-ken (JP; Takayuki Nishinohara, Tokyo (JP)" should read -- Hiroyuki Noguchi, Kawasaki (JP; Yasushi Ishida, Tokyo (JP: Shigeyuki Sugiyama, Hiratsuka (JP; Katsumi Obana, Funabashi (JP; Takayuki Nishinohara, Tokyo (JP) --.

(56) References Cited, OTHER PUBLICATIONS:

"U.S. Appl. No. 11/036,124, filed Jan. 18, 2005.
U.S. Appl. No. 11/032,173, filed Jan. 11, 2005.
U.S. Appl. No. 11/032,037, filed Jan. 11, 2005.
U.S. Appl. No. 11/0962,844, filed Feb. 23, 2005." should read -- U.S. Appl. No. 11/036,124, filed Jan. 18, 2005 (GAU 2622).
U.S. Appl. No. 11/032,173, filed Jan. 11, 2005 (GAU 2621).
U.S. Appl. No. 11/032,037, filed Jan. 11, 2005 (GAU 2621).
U.S. Appl. No. 11/0962,844, filed Feb. 23, 2005 (GAU 2622). --.

UNITED STATES PATENT AND TRADEMARK OFFICE

CERTIFICATE OF CORRECTION

PATENT NO. : 6,957,885 B2
APPLICATION NO. : 11/033146
DATED : October 25, 2005
INVENTOR(S) : Noguchi et al.

It is certified that error appears in the above-identified patent and that said Letters Patent is hereby corrected as shown below:

COLUMN 2:
Line 66, "forms a part therefor," should read -- form a part thereof --.

Signed and Sealed this

Twenty-ninth Day of August, 2006

JON W. DUDAS
*Director of the United States Patent and Trademark Office*